US011839274B2

(12) United States Patent
Greenberg

(10) Patent No.: US 11,839,274 B2
(45) Date of Patent: Dec. 12, 2023

(54) "PUFFY CHEEK PIG" PIGGY BANK

(71) Applicant: Leah Greenberg, Concord, MA (US)

(72) Inventor: Leah Greenberg, Concord, MA (US)

( * ) Notice: Subject to any disclaimer, the term of this patent is extended or adjusted under 35 U.S.C. 154(b) by 242 days.

(21) Appl. No.: 17/300,062

(22) Filed: Mar. 1, 2021

(65) Prior Publication Data

US 2022/0273080 A1 Sep. 1, 2022

(51) Int. Cl.
*A45C 1/12* (2006.01)
*A63H 3/00* (2006.01)

(52) U.S. Cl.
CPC ..... *A45C 1/12* (2013.01); *A63H 3/005* (2013.01)

(58) Field of Classification Search
CPC ..... A45C 1/12; A63H 3/005
See application file for complete search history.

(56) References Cited

U.S. PATENT DOCUMENTS 1,751,773 A * 3/1930 Trosper ..... A63H 3/24 446/304
2,448,807 A * 9/1948 Kimball ..... A45C 1/12 446/8
2,768,472 A * 10/1956 Whalen ..... A63H 33/00 446/8
RE24,355 E * 9/1957 Whalen ..... A63H 33/00 446/8
4,075,782 A * 2/1978 Neuschatz ..... A63H 3/48 446/295
5,135,421 A * 8/1992 Morris ..... A45C 1/12 446/901
9,427,054 B1 * 8/2016 Al-Saleh ..... A45C 1/12
2008/0233829 A1 * 9/2008 Sayles ..... A45C 1/12 446/8
2015/0034712 A1 * 2/2015 Moore ..... A45C 1/12 232/4 R

* cited by examiner

*Primary Examiner* — Christopher R Harmon

(57) ABSTRACT

A toy bank has a toy bank body having a coin slot. The bank also has an elastic material covering a portion of the toy bank body. The toy bank body is constructed such that the elastic material distends upon insertion of sufficient coins into the coin slot.

2 Claims, 2 Drawing Sheets

"PUFFY CHEEK PIG" PIGGY BANK

BACKGROUND

Quesnay hypothesized that all wealth comes from the land. A small part of this wealth, however, is stored in the piggy banks of young children. A piggy bank is a source of pride—providing both a sense of accomplishment and a burgeoning sense of financial independence. For example, a child can store money earned through household chores in a piggy bank to later buy Playmobil® figures. Many toy banks are in the form of an animal, such as a pig or cockapoo, and have a rigid structure that stores coins without providing a physical indication of the amount saved.

DETAILED DESCRIPTION

Figure 1:
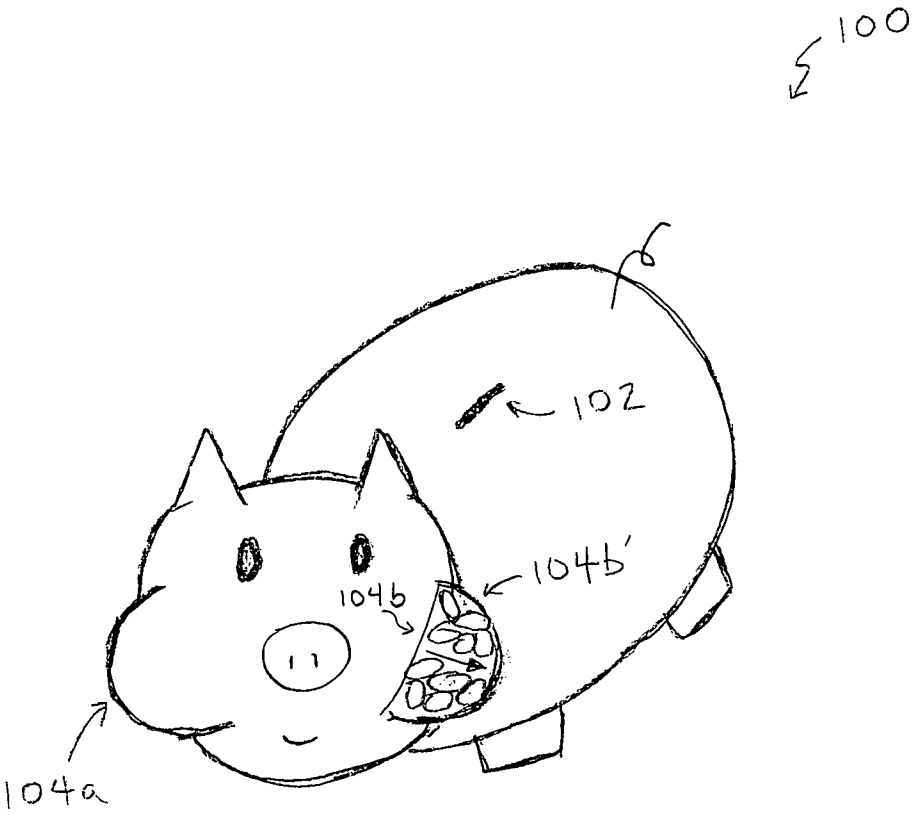
FIGS. 1 and 2 show a toy bank having an elastic portion that distends upon insertion of coins.

FIG. 1 depicts a toy bank 100 having a toy bank 100 body in the shape of a pig. The body may comprise a variety of hard or soft materials (e.g., molded rubber, plastic, ceramic, and/or glass) Like conventional toy banks, the toy bank 100 has a coin slot 102 for accepting coins and may include a plugged hole at the bottom (not shown) to empty coins. The toy bank 100 also includes two elastic portions 104*a*, 104*b* that can distend (e.g., flexibly expand outwardly relative to the curvature of the toy bank 100 body when no coins have been inserted) upon insertion of sufficient coins into the coin slot 102. For example, as shown elastic portion 104*b* distends to position 104*b*' upon insertion of sufficient coins. The elastic portion 104 may have some degree of translucence to provide at least a partial visual indication of the shape and physical appearance of inserted coins in the elastic 104 area.

FIG. 1 depicts a toy bank 100 body in the shape of a pig, however, a toy bank may be in various shapes such as different animals or other objects. As shown, the elastic material 104 may be situated at the cheek portion of the pig's face. However, other banks may feature elastic portions located at different animal body positions (e.g., at the stomach of a moose or a cow udder).

The elastic material 104 may be affixed to cover a cut out or aperture of the toy bank 100 body. For example, an adhesive, such as a glue, or other attachment mechanism (e.g., clip or staple) may attach the elastic material 104 to the toy bank 100 body. The elastic material 104 may comprise any of a number of materials such as rubber, latex, nylon, or Supplex among a list of suitable possibilities. While the toy bank 100 body may inherently have a small degree of elasticity, the elasticity of the elastic portion 104 is greater than the elasticity of the toy bank 100 body. The elastic material 104 may be a different material and/or a different thickness than the material composing the toy bank 100 body. The elastic material 104 thickness and/or material may be selected to permit the elastic material 104 to break when stretched too far, for example, to permit coins to spill out from the toy bank 100. For instance, the elastic material 104 may be selected to become discontiguous when the material distends by 3 cm. Other distention break points may be selected.

Figure 2:
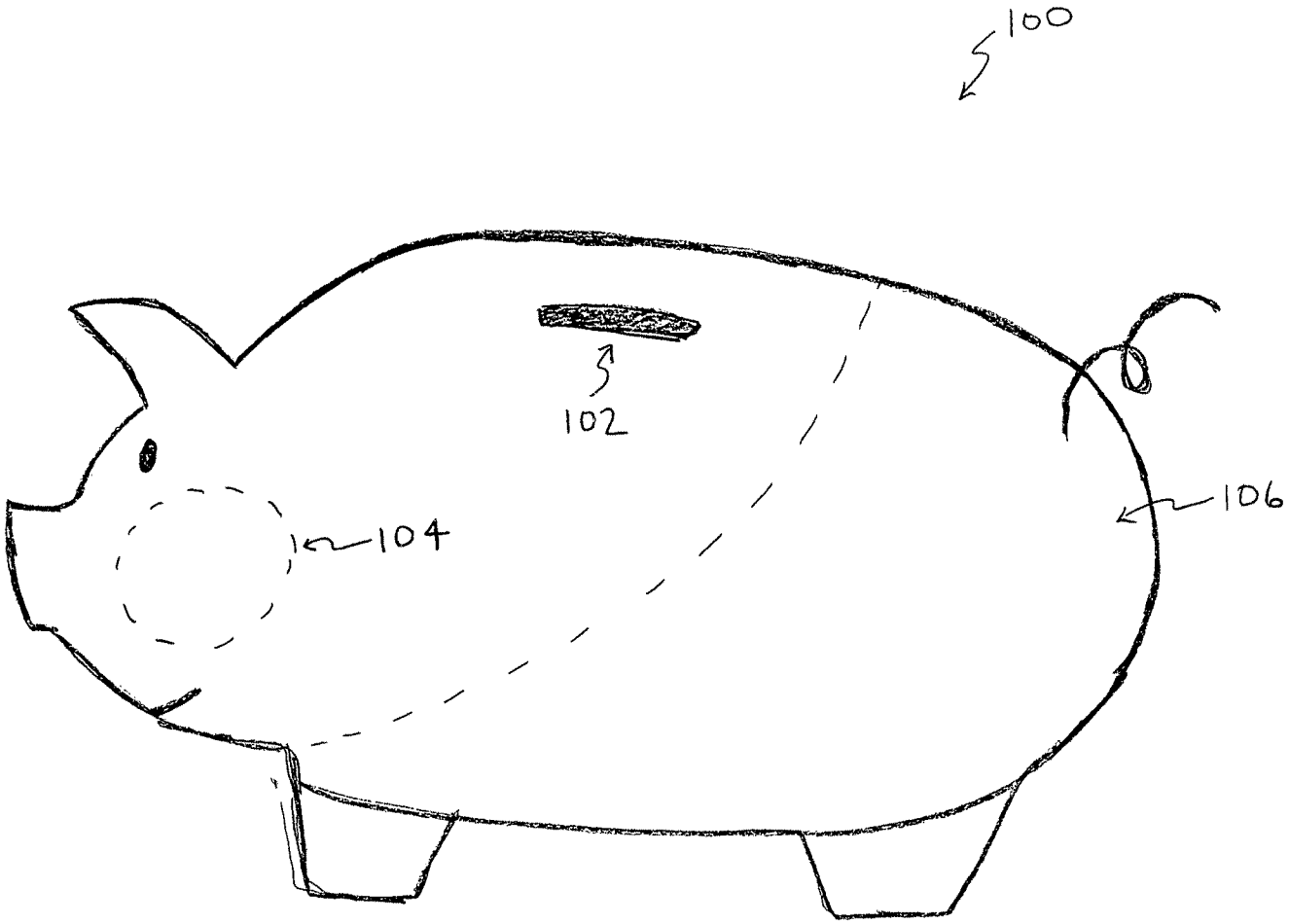

As shown in FIG. 2, the toy bank 100 interior volume may be significantly less than the volume of the toy bank 100 body. For example, interior volume may be decreased by the inclusion of an interior portion 106 that cannot be occupied by coins. For instance, the interior portion 106 may feature a wall or mass that reduces the interior volume and reduces the coins needed before the elastic portion 104 distends. The interior portion 106 may reduce the interior portion to ½ of the volume of the toy bank 100 body. Other interior portions 106, may reduce the interior portion to less than ½, less then ¾, or other reduced volumes relative to the toy bank 100 body.

The depicted toy bank 100 with "puffy cheeks" can provide a physical depiction of the amount a child has saved, providing children with an early form of Veblen's "conspicuous consumption". While no gift can ever adequately communicate the overwhelming love parents have for their child, the "puffy cheek pig" can be a lifelong symbol of the bursting joy parents have experienced during their offspring's childhood and delight in the rich future ahead.

What is claimed is:

1. A toy bank comprising: a piggy bank in the shape of a pig having a face portion and a body portion with a coin slot and a coin well; said face portion comprising opposing cheek portions comprising first and second elastic materials; said first and the second elastic materials comprising at least rubber or plastic material having an elasticity exceeding that of said body portion; said opposing cheek portions configured as coin quantity indicators which distend radially outward and in opposite directions with respect to each other; said coin well having a bottom surface extending below the opposing cheek portions; said bank configured such that an amount of coins inserted into the bank body coin slot will fill a volume defined by said coin well and thereafter said cheek portions will receive inserted coins and become distended indicating a corresponding amount of coins inserted into the bank.

2. The piggy bank of claim 1, where the elastic material comprises a translucent material.

* * * * *